United States Patent [19]

Crescenti

[11] 4,171,790

[45] Oct. 23, 1979

[54] FLORAL SUPPORT

[75] Inventor: James R. Crescenti, Valencia, Calif.

[73] Assignee: J. C. Smith, Inc., Valencia, Calif.

[21] Appl. No.: 881,136

[22] Filed: Feb. 24, 1978

[51] Int. Cl.[2] ..... A47G 7/00

[52] U.S. Cl. ..... 248/27.8; 248/459; 248/460

[58] Field of Search ..... 248/27.8, 121, 159, 248/174, 188.7, 450, 459, 460

[56] References Cited

U.S. PATENT DOCUMENTS

| | | | |
|---|---|---|---|
| 396,321 | 1/1889 | Baird | 248/159 X |
| 790,066 | 5/1905 | Lichter | 248/459 |
| 809,785 | 1/1906 | Dahlberg | 248/459 |
| 1,038,198 | 9/1912 | Randall et al. | 248/159 X |
| 1,090,142 | 3/1914 | Fischer | 248/174 |
| 1,132,629 | 3/1915 | Springman | 248/459 |
| 1,251,716 | 1/1918 | Wanner | 248/188.7 X |
| 1,463,585 | 7/1923 | Kellogg | 248/174 X |
| 2,771,260 | 11/1956 | Thom | 248/174 X |
| 3,292,796 | 12/1966 | Paige | 248/174 X |

*Primary Examiner*—William H. Schultz
*Attorney, Agent, or Firm*—Fraser and Bogucki

[57] ABSTRACT

A disposable floral support is provided that is inexpensive, compactly stored and transported as separate parts, then readily assembled into a variety of configurations having pleasing aesthetic values. The floral support includes a base member assembled from individual planar elements, such as cardboard, interlocked into a cruciform shape. The base member includes means for receiving a riser or post comprising a selectable number of interlocking tube segments which may be arranged to give a particular height for a specific floral display. An easel or other top support structure is attached to the uppermost end of the post. An easel is provided, for example, by a folded cardboard element having a triangular front face and including an interior fold-down panel and a folding tab or tongue for registry into the upper end of the uppermost tube. Side panels may be folded back from the face surface member to be coupled together at a rear margin, while an aperture in the fold-down panel receives the uppermost tube length, so as to hold the easel member in position at a given angle of inclination. Alternatively, a floral support of a different kind may be utilized interchangeably by employing an inverted base member. Whatever the configuration, the advantages of low cost, compact storage and transport, and rapid assembly are maintained.

12 Claims, 10 Drawing Figures

FIG. 1
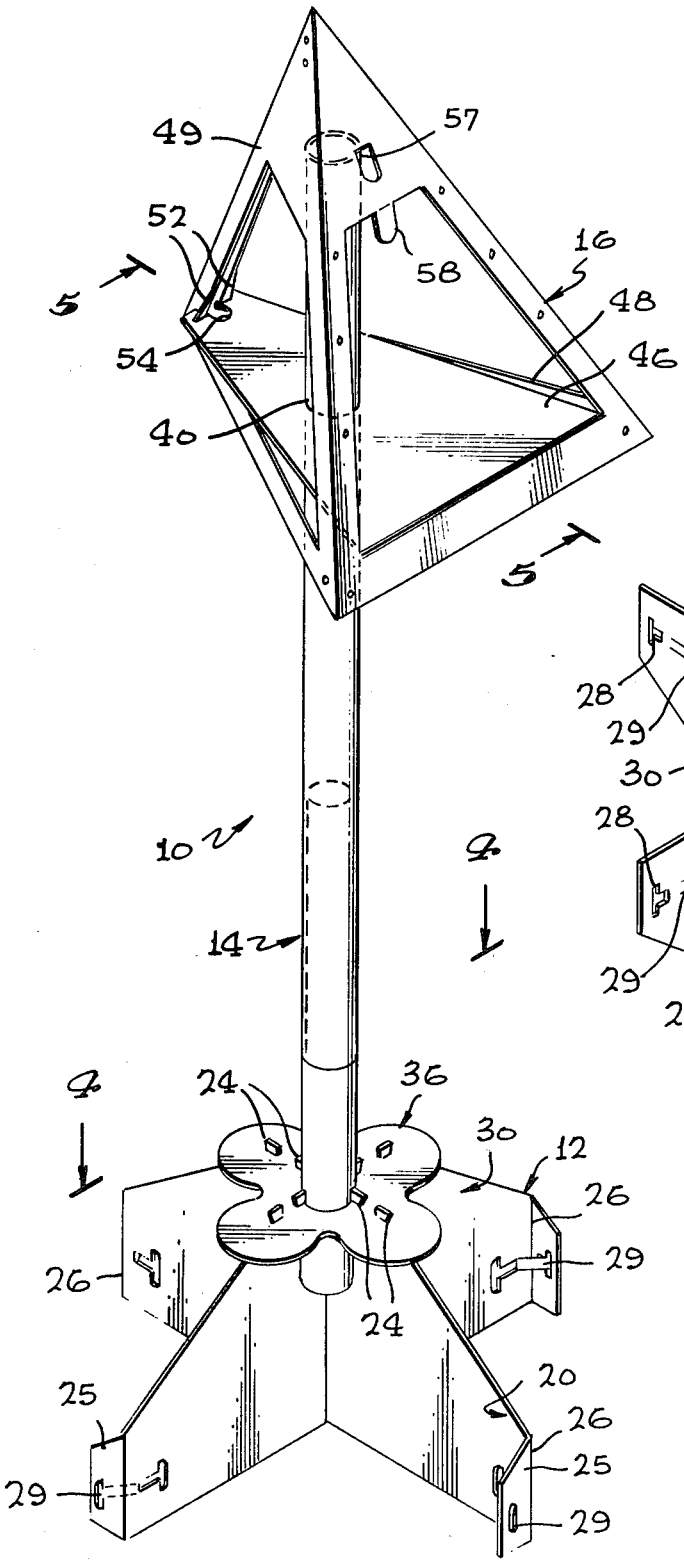
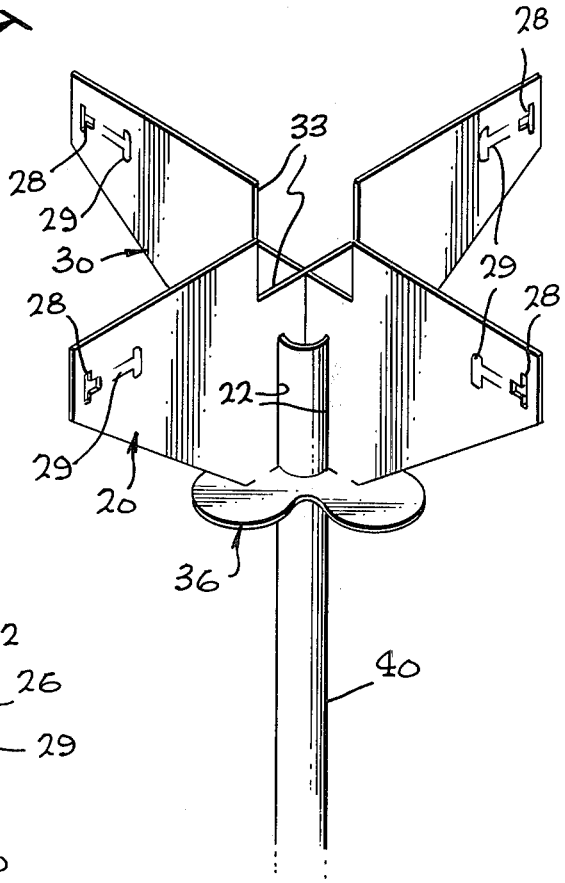
FIG. 2

FLORAL SUPPORT

BACKGROUND OF THE INVENTION

Despite the widespread and constant use of floral display systems, there have been few basic improvements in the support structures that are employed for such displays. For example, it is common to employ wooden trees, wooden and wire easel structures, and various other forms of supports for wreaths, cross, hearts, standing sprays, and hanging plants in conjunction with funeral services, weddings and the like. Such structures have one or more serious deficiencies from the standpoint of the florist who must use them. In practice, it is typically required to transport not only floral wreaths but also the floral stands from one point to another in conjunction with services or ceremonies. Thus the more compactly the support structures can be stored for transport, the fewer the number of vehicles needed for a large display. Similarly, a more compact structure permits a substantial inventory of floral supports to be stored for future use with a minimum of space. With the wooden trees and other structures currently in use, weight as well as size is a problem, in handling as well as in transport. In addition, once arriving at the site of a service or ceremony, and having prepared the display for use, it would be preferable simply to dispose of the supports rather than attempt to return them for reuse. This in turn would require that the supports be of sufficiently low cost to permit their use as disposables.

Furthermore, it is evident that fixed or rigid support configurations are suitable for only certain types of displays. Wreaths of different sizes may be displayed on an easel or pedestal, for example, and with these it may be desirable to vary the height of the display, or to permit variation in the wreath size without having the support structure become too obtrusive on the one hand or provide inadequate support on the other.

As another consideration, a slanted easel is not a suitable support for a number of different types of floral displays, such as trailing or other plants which may be grown in pots or other containers. Thus the capability of a floral support for versatile usage is extremely important, because it frees the florist from the need for a large inventory of special types of easels, pedestals and other supports, and because it permits on site modification of displays for best effect.

SUMMARY OF THE INVENTION

A floral support in accordance with the invention comprises modular components that may be stored in very compact form, but assembled at a display location into any of a wide variety of forms. The base comprises planar interlocking panels including means for receiving a post comprising a series of mating tube lengths which may be assembled into a given total length. The top support member may then comprise either an angled easel formed of a folded planar member, or may comprise an inverted base member for a different type of display. The angled easel member is held in position by an interlocking tab or tongue registering within the uppermost tube length, and a fold-down panel including an aperture for retaining the easel in the desired angular position.

In a more specific example of the floral support in accordance with the invention, the base member is formed as a pair of cardboard panels including oppositely directed slots which permit them to be arranged into a cruciform shape. The panels also include slots extending downward from their upper edges to receive the bottom one of a series of tube lengths, and upstanding tabs which register within slots in a locking ring that maintains the two panels in position. Terminal wings on each of the lateral panel ends may be folded to an angle substantially perpendicular to the major surface of each panel, and locked in place by integral folding fingers, so as to permit the floral support to carry greater weight. The interlocking tube lengths may be hollow cardboard tubes having a male or female receiving section at one end to permit assembly of a succession of tubes. Using only two tube lengths of 2' and 3' respectively, a support post having an integral height of greater than 2' may be assembled simply by utilizing the proper combination of tube lengths. Where the upper support is to be formed as an easel, the easel advantageously comprises a precut perforated cardboard panel which is foldable into a triangular pyramid having a face surface at a desired angle relative to the vertical. The fold-down panel depending from the interior of the face surface includes a guide aperture for receiving the post and is substantially horizontal when in position, thus providing a potential support for a floral arrangement if desired. The side panels are foldable backwardly relative to the face surface, and lockable at the rear margin, to provide a strong unified structure. To accommodate smaller wreath sizes, the uppermost part of the top support can be truncated either by folding down or cutting off this portion. In addition, flowers, leaves and decorations can be attached in a number of different ways, as by stapling to the cardboard, giving the florist an extremely wide range of display options.

BRIEF DESCRIPTION OF THE DRAWINGS

A better understanding of the invention may be had by reference to the following description, taken in conjunction with the accompanying drawings, in which:

FIG. 1 is a perspective view of a floral support in accordance with the invention;

FIG. 2 is a perspective view of a fragment of another floral support in accordance with the invention using an inverted base as the top support;

DETAILED DESCRIPTION OF THE INVENTION

Figure 3:
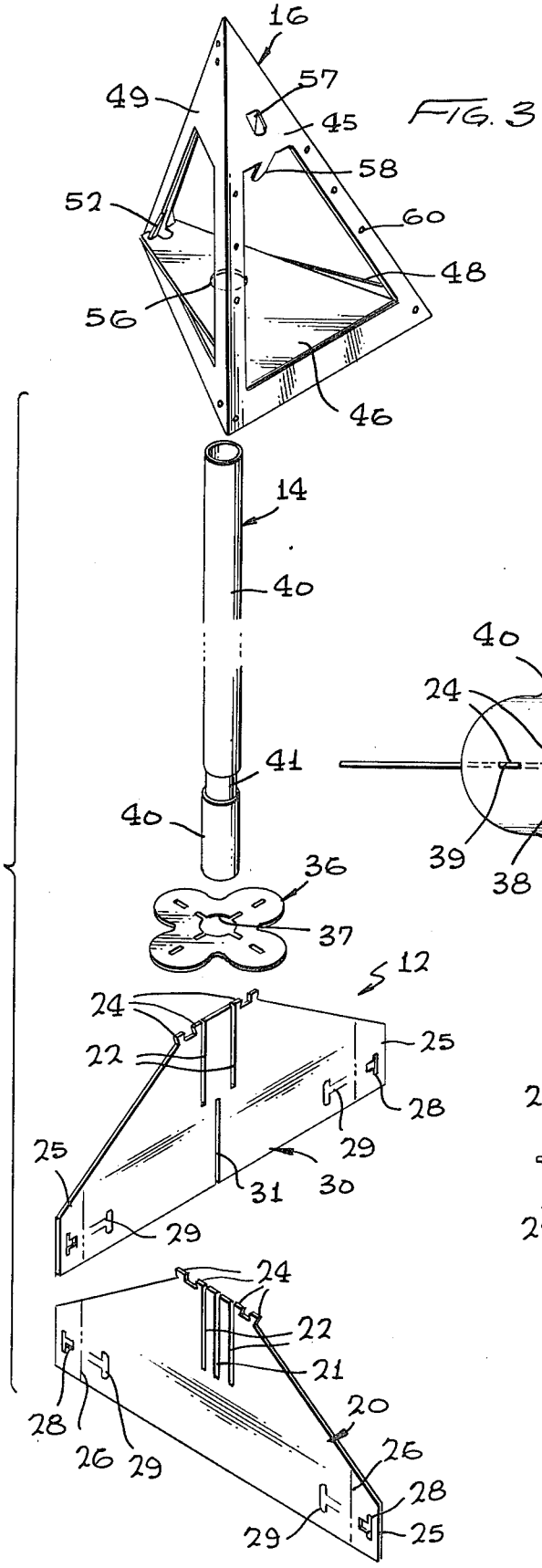
FIG. 3 is an exploded perspective view of the arrangement of FIG. 1.

A floral support 10 in accordance with the invention, as seen in FIG. 1, comprises a base 12, here of cruciform structure, a post or riser 14 of selectable height and a top support structure 16. The entire structure may be fabricated from modular pieces of cardboard or other inexpensive panel and tube material, although a variety of other relatively low cost materials of adequate strength may be employed. In the present example, single fluted 200 weight cardboard has been found to provide an advantageous combination of extremely low cost, light weight and more than adequate strength. The base structure 12 and the top support surface 16 may be concurrently printed, cut and perforated or indented for fold or crease lines in conventional fashion, and may be printed with a light color or a floral pattern for a pleasing background for whatever floral decoration is to be used.

Figure 7:
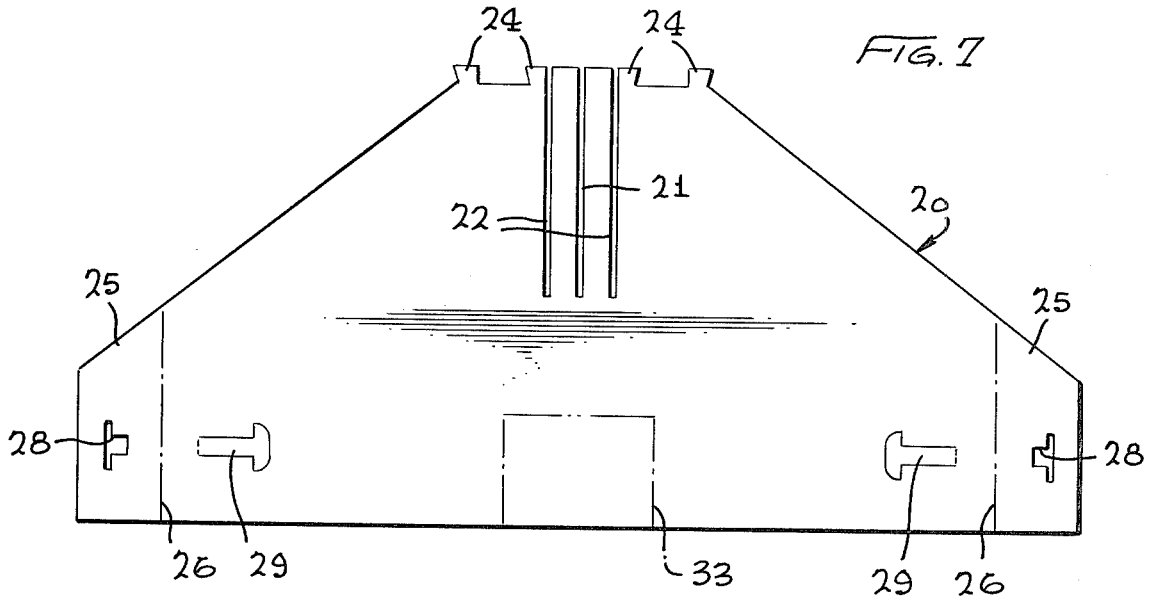
FIG. 7 is a plan view of one planar member utilized in a base structure in the arrangement of FIG. 1.

The base 12 includes two planar half sections and a base locking ring, shown in different figures hereafter in addition to FIGS. 1 and 3. As best seen in FIGS. 3 and 7, a first planar half section 20 includes a center top slot 21, extending downwardly from the top surface of the member and being aligned in the vertical position when the base is in its normal operating orientation. A pair of vertical tube slots 22 are positioned adjacent the center top slot 21, to receive the bottom-most section of the post that is to be coupled into the base, and these tube slots 22 are of a width which gives a snug fit with the tube length. Upstanding tabs 24 extending from the uppermost margin of the first planar member 20 lie in a common upper plane to provide locking elements that are used as described hereinafter. The lateral or horizontal ends of the member 20 constitute terminal wings 25 which may be folded along vertical crease lines 26 so as to assume positions approximately perpendicular to the principal plane of the first planar member 20. T-slots 28 positioned in each of the wings 25 are configured to receive the ends of folding T-shaped fingers 29, the principal outlines of which are cut into the member 20.

Figure 4:
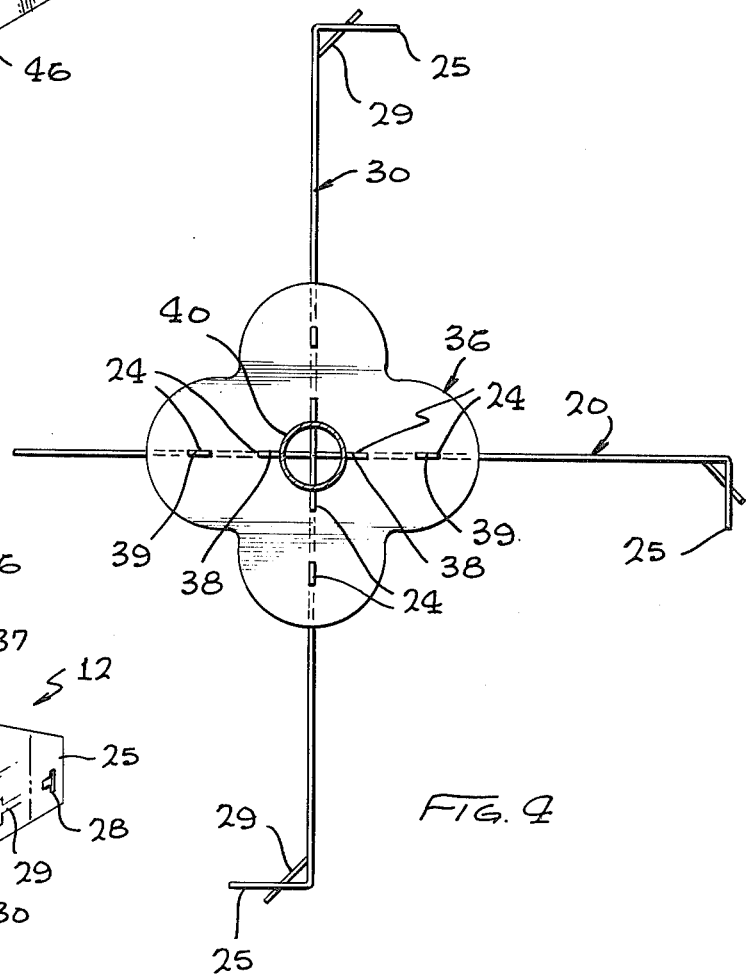
FIG. 4 is a plan sectional view of the base portion of the structure of FIG. 1, taken along the lines 4—4 in FIG. 1, and looking in the direction of the appended arrows.
Figure 8:
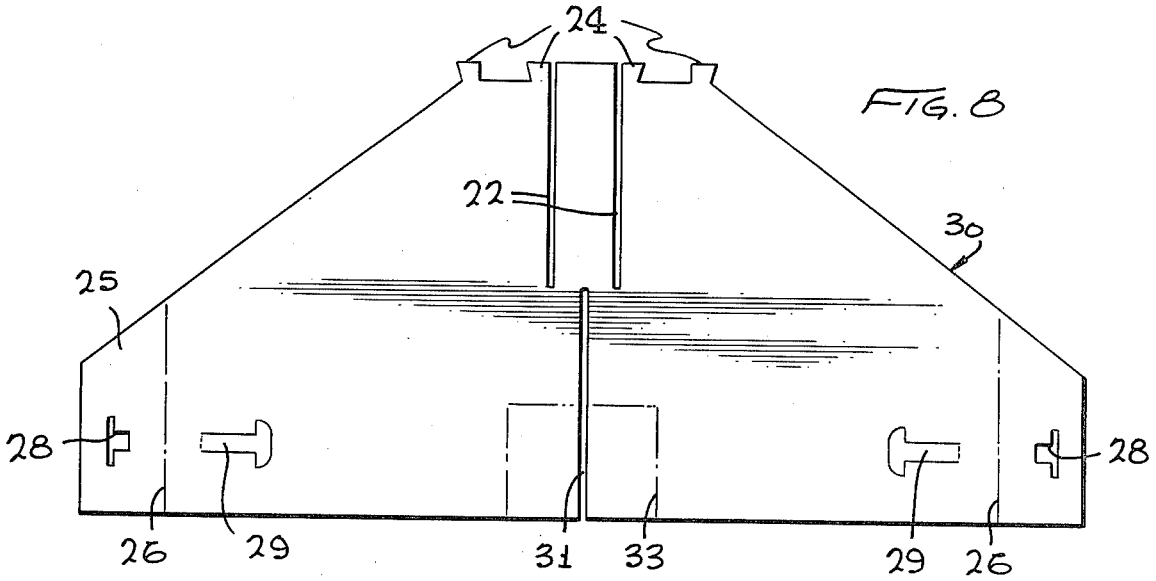
FIG. 8 is a plan view of a second planar member utilized in a base structure in the arrangement of FIG. 1.

The second planar half 30 (see FIGS. 3 and 8) is configured generally similar to the first member 20, but includes a center bottom slot 31 lying along the central vertical axis. Tube slots 22 and upstanding tabs 24 are incorporated on this second planar member 30 as previously described. As shown in dotted lines in both FIGS. 3 and 4, both planar halves 20, 30, may include bottom cut-out portions 33 symmetrical with the central vertical axis. These cut-out portions 33 may be employed when a base portion is to be used in the inverted mode, as described hereafter.

Figure 9:
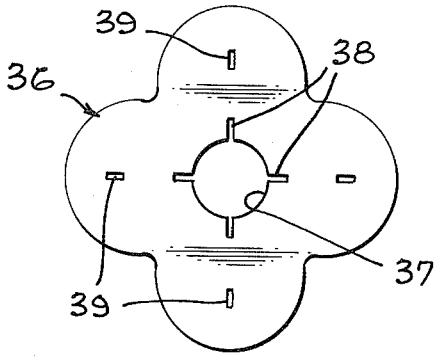
FIG. 9 is a plan view of a support retainer for the base structure used in the arrangement of FIG. 1.
Figure 10:
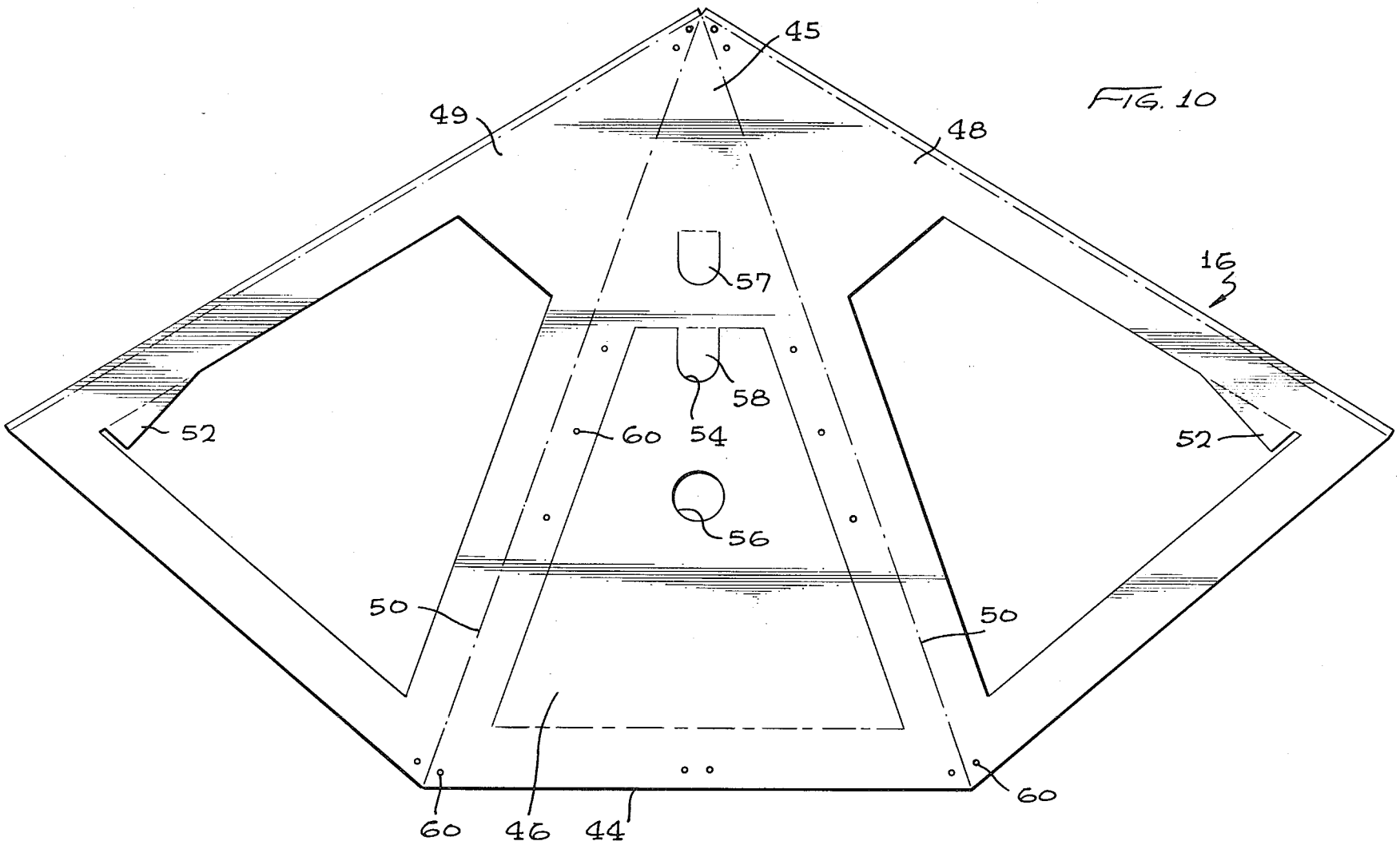
FIG. 10 is a plan view of an unfolded top support structure that may be used in the arrangement of FIG. 1.

Thus it may be seen that the two planar halves 20, 30 of the base 12 may be interlocked with the second half fitted into the top slot 21 of the first half, while the first half is received within the bottom slot 31 of the second half, giving the desired cruciform shape with the bottom base edges lying in a common plane. As may be seen from FIGS. 3 and 9, a base locking ring 36 including a central aperture 37 and sets of inner slots 38 and outer slots 39, respectively, may be disposed on the top side of the base 12, with the slots 38, 39 receiving the upstanding tabs 24 so as to lock the two planar halves 20, 30 into their respective radial positions. The slots 38, 39 are sized to give a snug fit with the upstanding tabs 24.

The post or riser section 14 (see FIGS. 1 and 3) comprises a series of tube lengths 40, the tubes also being of cardboard of approximately 0.13" thickness in this example. Each tube length 40 includes a protruding male insert 41 attached inside one end, to receive the next uppermost tube length. In practice, it is found convenient to employ various combinations of 2' and 3' tube lengths 40, because it is seldom that an easel or pedestal will be required to be less than 2' or 3' in height, and the desired total height, in incremental foot measurements thereafter, may be supplied by various combinations of only these two lengths. The bottom tube length 40 is fitted into the tube slots 22 in the base 12, and thereby securely held in position against the weight of the floral display and any reasonable wind-loading forces that are likely to be encountered.

Figure 5:
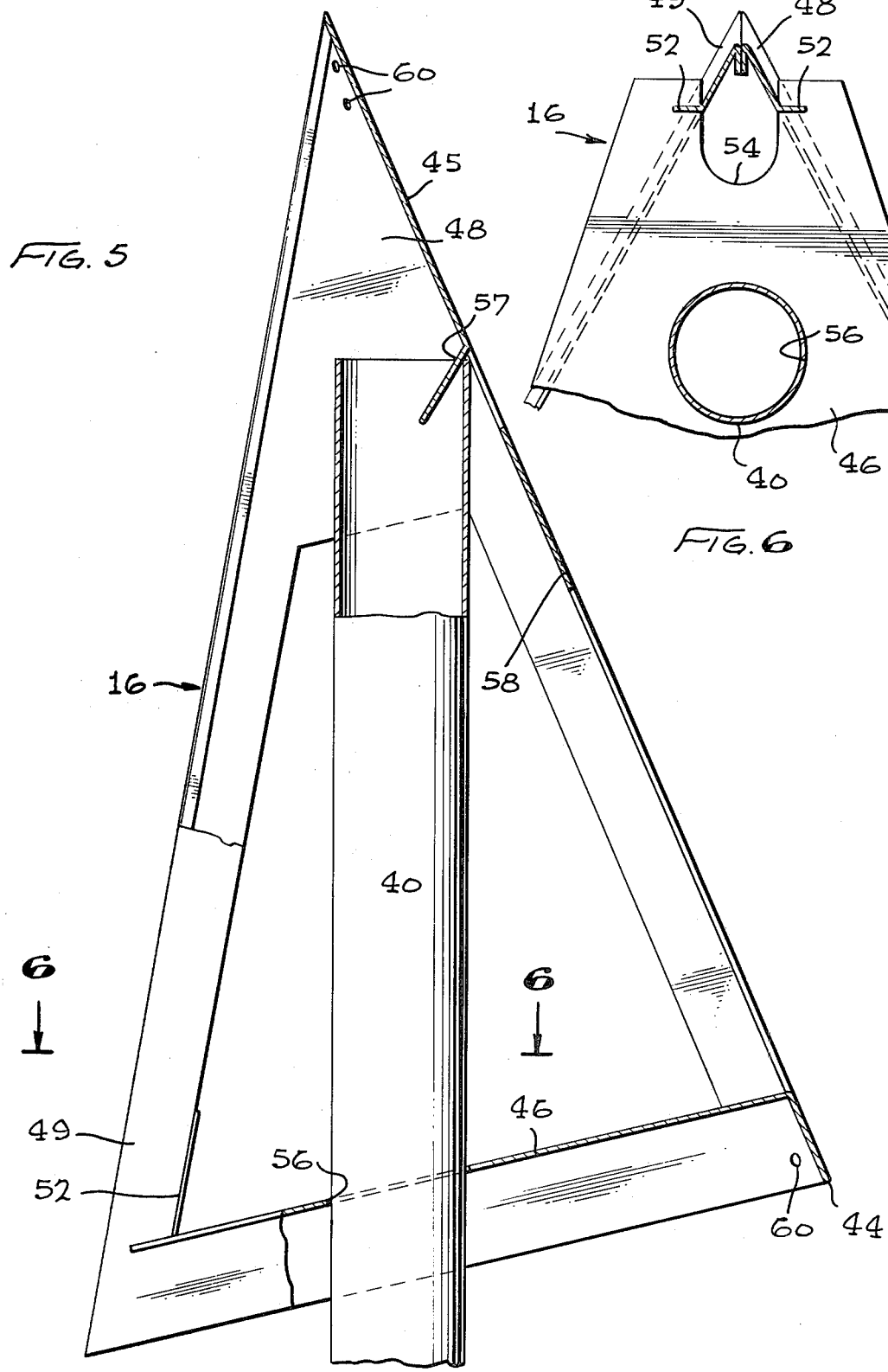
FIG. 5 is a side sectional view of the top support portion of the structure of FIG. 1, taken along the lines 5—5 in FIG. 1 and looking in the direction of the appended arrows.
Figure 6:
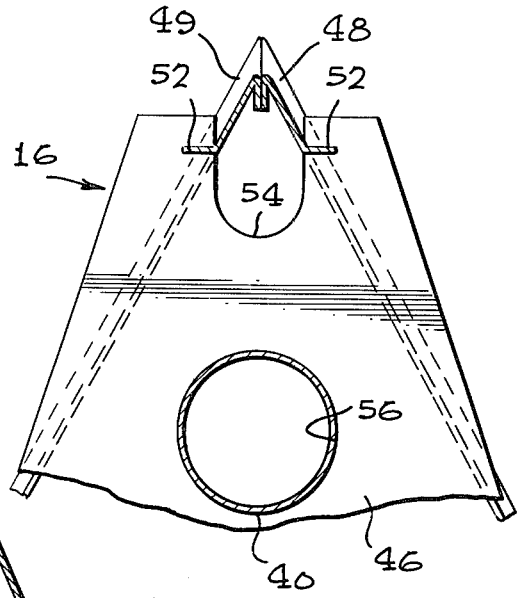
FIG. 6 is a fragmentary plan view of a section of the arrangement of FIG. 5, taken along the lines 6—6 and looking in the direction of the appended arrows.

As shown in FIGS. 1 and 3, and referring now also to FIGS. 5 and 6, the angled easel or top surface member 16 comprises another cardboard planar section 44. The bottom edge of a triangular front face 45 will be horizontal when this easel section 16 is mounted into position. A fold-down section 46 in the central portion of the triangular front face 45 is cut along side and top edges, and perforated along a bottom horizontal line, so that it may be folded inwardly toward a generally horizontal position. Side panels 48, 49 are foldable backwardly relative to the front face 45 along perforated lines 50. The side panels 48, 49 include central cut-out sections and rear margins strips. Small triangular locking tabs 52 at the bottom portion of these rear margin strips are at the rear of the assembly when the side panels 48, 49 are folded back. When in this position, the rear margins of the side panels 48, 49 are in abutment, and the strips register within a U-slot 54 in the free end of the fold-down section 46, as best seen in FIG. 6. The tabs 52 may then be folded outwardly to lock the fold-down section 46 in position. The fold-down section 46 also includes a guide aperture 56 which receives the top tube length 40 of the central post and centrally positions the easel 16 about the post section 14. The top end of the central post 14 receives either of two tabs or tongues 57, 58 provided in the front face 45. The first (uppermost) tongue 57 is cut into the front face 45, and foldable downwardly to be inserted into the uppermost end of the top tube length. For a greater angle of inclination of the front face 45, the second, lower tongue 58, may be used. Either tongue 57, 58 securely bears the weight of the decorated easel.

A numer of small apertures 60 are included in or adjacent the front face 45 to provide points for attachment of 24" and 30" wreaths at different positions. Although a substantial number of variations will be understood to be available, the configuration of FIG. 6, with a total height of 26", is found to be particularly suitable for receiving either 24" or 30" wreaths, the most commonly used sizes, as desired.

Referring again to FIGS. 1 and 3 particularly, it will be appreciated that a supply of all of the modular elements desired for different floral displays can be stocked in very little space, for use as desired. When preassembled, the units are still sufficiently compact so that a substantial number can be transported. When to be used at the site of a given service or ceremony, however, the components can be shipped in the knocked down condition, and assembled directly on the site without the use of any other tools or equipment. The support thus can provide a pedestal of any desired height, varying in increments of one foot from a minimum height of two feet (if that is the shortest tube length employed). With the capability that the system affords for displays of different sizes and different methods of attachment, the florist can use great versatility in design. Crosses, hearts, standing sprays and other patterns may be used as desired. Leaves, ribbons and other elements may be separately attached, as by stapling to the cardboard. The central platform defined by the hang-down panel 46 may also be used in unique ways. After a suitable period of display, the floral support can be disposed of conveniently and without difficulty.

It is also feasible to utilize added support, or to provide separate support, for the riser section, utilizing a spike that can be driven into the ground and an interior or exterior fitting with respect to the bottom tube length. Alternatively ground spikes may be secured at the locking T-slots 28 or tongues 29. These expedients may be employed where the ground slope is excessive, or high weight or wind-loading forces need to be supported. Usually, however, it is sufficient to fold the wings 25 in the base 12, and to lock them in position with the tongues 29.

A different type of display is also achievable in accordance with the same modular construction as shown in FIG. 2. In this example, an inverted base section, with the cut-out portion 33 now presenting the top surface, provides a suitable holder for a plant or other container. By folding the end wings back, the outer radius of the top support can be reduced, so that trailing branches may be laid over the side for a uniform and attractive display. Alternatively, the end wings may be cut off for similar purposes.

Although various forms and variations of floral supports in accordance with the invention have been described above, it should be appreciated that the invention encompasses all modifications and variations within the scope of the appended claims.

What is claimed is:

1. A floral support comprising:

a base member comprising at least a pair of members in a cruciform configuration and defining a receiving aperture;

riser means comprising a succession of tube lengths, the bottom one of which fits into the receiving aperture;

upper support means comprising planar panel means including means registering with the upper one of the tube lengths and being supported thereon, and further including a triangular face surface member angled to the vertical and having a fold-down panel, and a pair of folded side surface members coupled together along abutting margins to define a triangular pyramidal shape.

2. The invention as set forth in claim 1 above, wherein the base member comprises a pair of upstanding panels that are orthogonally disposed and include foldable terminal segments at each lateral end.

3. The invention as set forth in claim 1 above, wherein the upper support means includes a folding tab for registry in the uppermost tube length, and the fold-down panel includes a guide aperture receiving the associated tube length when folded down to a general horizontal position rearwardly of the tube face.

4. The invention as set forth in claim 3 above, wherein the base member comprises a pair of interlocking crossed panels having base edges lying in a common plane and upper edges lying in a common plane, and including in addition locking ring means coupled to the panels in the plane of the upper edges.

5. A cardboard panel member foldable into a floral support and securely mountable at a selected angle on the top of a hollow post, comprising:

a front panel surface including a centrally disposed fold-down area separated from the surface along its periphery except along a bottom fold line, the front panel surface including at least one depending tab above the fold-down area and the fold-down section including a guide aperture therein;

and side panel surfaces foldable backwardly from the front panel surface and including means for coupling to the fold-down section.

6. The invention as set forth in claim 5 above, wherein the member is foldable into a triangular pyramid and the side panels are centrally apertured to define rear margins, and the rear margins are in abutment when the side panels are folded into position.

7. The invention as set forth in claim 6 above, wherein the free end of the fold-down section includes terminal slot means locking the rear margins of the side panels when folded into substantially horizontal position, and wherein in addition the side panels include foldable locking tabs extending from the rear margins and engaging the fold-down section when in position.

8. A disposable floral support comprising:

a base member comprising at least a pair of members in a curciform configuration and including slots defining a receiving opening;

a central post comprising a succession of cardboard tube lengths, the bottom one of which fits into the receiving opening;

and upper support means comprising a folded planar cardboard panel defining a triangular pyramid and including means registering with the upper one of the tube lengths, a triangular face surface member angled to the vertical and having a centrally disposed fold-down panel that may be folded to a substantially horizontal position along a bottom fold line, and a pair of side surface members folded backwardly from the face surface member and having rear margins in abutting relation to define the triangular pyramidal shape when so folded, the side surface members also including central apertures defining rear margin strips, the fold-down panel engaging said rear margin strips when in position.

9. The invention as set forth in claim 10 above, wherein the means registering with the upper one of the tube lengths comprises a depending tab in the face surface member, and the fold-down panel includes a substantially centrally disposed guide aperture for receiving the central post to maintain the upper support means with the face surface member at a selected angle.

10. The invention as set forth in claim 9 above, wherein the upper support means further includes means defining a V-shaped slot in the free end of the fold-down section for engaging the rear margin strips, and the rear margin strips further include folding tabs positioned to restrain the fold-down section when folded outwardly.

11. The invention as set forth in claim 10 above, wherein said base member panels include means defining oppositely directed vertical slots along a central axis for fitting said panels together in interlocking relation, and upstanding tabs on the upper edges thereof, and said base member further includes locking ring means orthogonal to the panels and including a central aperture receiving the central post and slots receiving the upstanding tabs.

12. The invention as set forth in claim 11 above, wherein said base member panels include vertical slots extending downwardly from the upper edges thereof, at equal radial distances from the central axis, and terminal wing portions at each horizontal end thereof, said wing portions each including a slot aperture, and said panels including individual foldable tongue elements spaced like distances apart from the slot apertures and engageable therein when the wing portions are folded orthogonally relative to the associated panel.

* * * * *